US007952549B2

(12) United States Patent
Lee et al.

(10) Patent No.: US 7,952,549 B2
(45) Date of Patent: May 31, 2011

(54) FIELD SEQUENTIAL DISPLAY APPARATUS THAT REDUCES COLOR BREAKUP AND METHOD THEREOF

(75) Inventors: Young-ho Lee, Yongin-si (KR); Seung-joon Yang, Seoul (KR); Ki-hyun Hong, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 786 days.

(21) Appl. No.: 11/441,148

(22) Filed: May 26, 2006

(65) Prior Publication Data

US 2007/0025613 A1 Feb. 1, 2007

(30) Foreign Application Priority Data

Jul. 27, 2005 (KR) ..... 10-2005-0068618

(51) Int. Cl.
*G09G 3/36* (2006.01)

(52) U.S. Cl. ..... 345/88

(58) Field of Classification Search ..... 345/87–111, 345/204–211, 690–699; 315/169.1–169.2
See application file for complete search history.

(56) References Cited

U.S. PATENT DOCUMENTS

| | | | | |
|---|---|---|---|---|
| 6,256,425 | B1 | 7/2001 | Kunzman | |
| 6,392,656 | B1 * | 5/2002 | Someya et al. | 345/589 |
| 6,453,067 | B1 | 9/2002 | Morgan et al. | |
| 2002/0063670 | A1 * | 5/2002 | Yoshinaga et al. | 345/87 |
| 2002/0113761 | A1 * | 8/2002 | Mizutani et al. | 345/87 |
| 2002/0122019 | A1 * | 9/2002 | Baba et al. | 345/88 |
| 2003/0214725 | A1 * | 11/2003 | Akiyama | 359/640 |
| 2004/0246275 | A1 * | 12/2004 | Yoshihara et al. | 345/690 |
| 2005/0046753 | A1 * | 3/2005 | Kwak | 348/745 |

FOREIGN PATENT DOCUMENTS

| | | | |
|---|---|---|---|
| JP | 2002-169515 | A | 5/2002 |
| JP | 2002-229531 | A | 8/2002 |
| JP | 2004-004626 | A | 1/2004 |
| KR | 10-2002-0039141 | A | 5/2002 |
| KR | 10-2004-0042402 | A | 5/2004 |
| KR | 10-2004-0083786 | A | 10/2004 |

OTHER PUBLICATIONS

Communication dated Jun. 11, 2009 issued by the Netherlands Patent Office.

* cited by examiner

*Primary Examiner* — Chanh Nguyen
*Assistant Examiner* — Long Pham
(74) *Attorney, Agent, or Firm* — Sughrue Mion, PLLC

(57) ABSTRACT

A field sequential display apparatus and an image display method thereof are provided. A field sequential display apparatus includes: a color-coordinate conversion unit which analyses image state information of a plurality of input image signals of primary colors representing one image and converts the input image signals of primary colors into image signals of primary colors and at least one image signal of specific colors by using the image state information; a display panel displaying the converted image signals; and a light source driving unit which sequentially drives light sources corresponding to colors of the converted image signals. Accordingly, color breakup can be prevented, and image quality can be improved.

13 Claims, 7 Drawing Sheets

FIELD SEQUENTIAL DISPLAY APPARATUS THAT REDUCES COLOR BREAKUP AND METHOD THEREOF

CROSS-REFERENCE TO RELATED PATENT APPLICATION

This application claims priority from Korean Patent Application No. 10-2005-0068618, filed on Jul. 27, 2005 in the Korean Intellectual Property Office, the disclosure of which is incorporated herein in its entirety by reference.

BACKGROUND OF THE INVENTION

1. Field of the Invention

The present invention relates to a display apparatus, and more particularly, to a field sequential display apparatus that reduces color breakup and a method thereof.

2. Description of the Related Art

A liquid crystal display apparatus commonly includes upper and lower substrates, a liquid crystal panel composed of a liquid crystal between the upper and lower substrates, a driving circuit which drives the liquid crystal panel, and a backlight unit which provides white light to the liquid crystal.

Methods of operating the liquid crystal display apparatus can be classified into RGB (red, green, blue) color filter methods and color field sequential drive methods.

In a liquid crystal display apparatus using the RGB color filter method, each pixel is divided into RGB unit pixels, RGB color filters are respectively provided in the RGB unit pixels, and light is transferred to the RGB color filters through the liquid crystal by the backlight unit, thereby forming a color image.

In a liquid crystal display apparatus using the color field sequential drive method, RGB light sources are arranged in each pixel instead of decomposing the pixel into RGB unit pixels, and light of the three primary colors R, G, and B is sequentially transferred from the RGB backlight to each pixel through the liquid crystal in a time division manner, thereby displaying a color image using an afterimage effect.

FIG. 1 shows a basic method of driving a backlight of a field sequential display apparatus according to the related art.

Referring to FIG. 1, one image field is divided into RGB sub-fields to be displayed on a screen. Data R is first displayed on a liquid crystal panel, a light source R is turned on after the liquid crystal responses completely, light source R is then turned off to display data G on the liquid panel, a light source G is turned on after the liquid crystal responses completely, light source G is then turned off to display data B on the liquid panel, a light source B is turned on after the liquid crystal responses completely, thereby forming one screen. However, the basic method of driving the backlight of FIG. 1 has a short turn-on time of the backlight due to an image data input and response time of the liquid crystal, which reduces the contrast. Therefore, to solve this problem, a drive method of using a scrolling backlight has been introduced.

FIG. 2 shows a drive method using a scrolling backlight of a field sequential display apparatus according to the related art.

Referring to FIG. 2, in the drive method using the scrolling backlight, a screen is divided into areas, and different light sources are used for each of the areas. Namely, a light source is first activated for an area where the liquid crystal responses completely, and other color light sources are activated for other areas. The drive method using the scrolling backlight can have a greater turn-on time of the light source than a basic drive method. However, in the scrolling backlight drive method, color purity may deteriorate due to a color mixture of light sources, since light sources of different colors are concurrently turned on for one screen. To solve this problem, a barrier rib (separating rib) may be placed between separately driven areas to prevent interference between light sources. However, if the barrier rib is used to prevent the color mixture, luminance may vary because the portion where the barrier rib is positioned receives less light than other portions.

In addition, in a field sequential drive method according to the prior art, if a moving white image is represented by a mixture of the three primary colors R, G, and B, color breakup occurs at the leading and trailing edges, since the R, G, and B colors are represented with a time difference as the picture moves.

SUMMARY OF THE INVENTION

The present invention provides a field sequential display apparatus that prevents varying luminance and color breakup, and a method thereof.

According to an aspect of the present invention, there is provided an image display apparatus using a field sequential driving method, comprising: a color-coordinate conversion unit which analyses image state information of a plurality of input image signals of primary colors representing one image and converts the input image signals of primary colors into image signals of primary colors and at least one image signal of specific colors by using the image state information; a display panel displaying the converted image signals; and a light source driving unit which sequentially drives light sources corresponding to the colors of the converted image signals.

According to another aspect of the present invention, there is provided an image display method using a field sequential driving method, comprising: analyzing image state information of a plurality of input image signals of primary colors representing one image and converting the input image signals of primary colors into image signals of primary colors and at least one image signal of specific colors by using the image state information; and displaying the converted image signals of primary colors and the image signal of the specific colors by sequentially driving light sources corresponding to the colors of the converted image signals.

BRIEF DESCRIPTION OF THE DRAWINGS

The above and other aspects of the present invention will become more apparent by describing in detail exemplary embodiments thereof with reference to the attached drawings in which.

According to yet another aspect of the present invention, there is provided a computer-readable medium having embodied thereon a computer program for executing an image display method using a field sequential driving method, the image display method including: converting a plurality of first image signals of primary colors into second image signals of the primary colors and at least one specific color based on image state information of the first image signals of the primary colors; and displaying the second image signals of the primary colors and the at least one specific color by sequentially driving light sources corresponding to the primary colors and the at least one specific color of the second image signals.

DETAILED DESCRIPTION OF EXEMPLARY EMBODIMENTS OF THE INVENTION

Exemplary embodiments of the present invention will now be described in detail with reference to the accompanying drawings.

In an image display apparatus using a field sequential driving method of the present invention, image signals of primary colors which are input to the image display apparatus are converted into image signals of primary colors and an image signal of a specific color. The converted image signals of primary colors and a specific color are sequentially driven to display an image. Color breakup can be prevented in the present invention by reducing the levels of the image signals of the primary colors and increasing the level of the image signal of a specific color. The primary colors are normally red R, green G, and blue B. However, more colors may be used for a wider color gamut. The present invention will mainly be described for the case of using RGB primary colors as an image signal, but the primary colors may include more colors.

Figure 1:
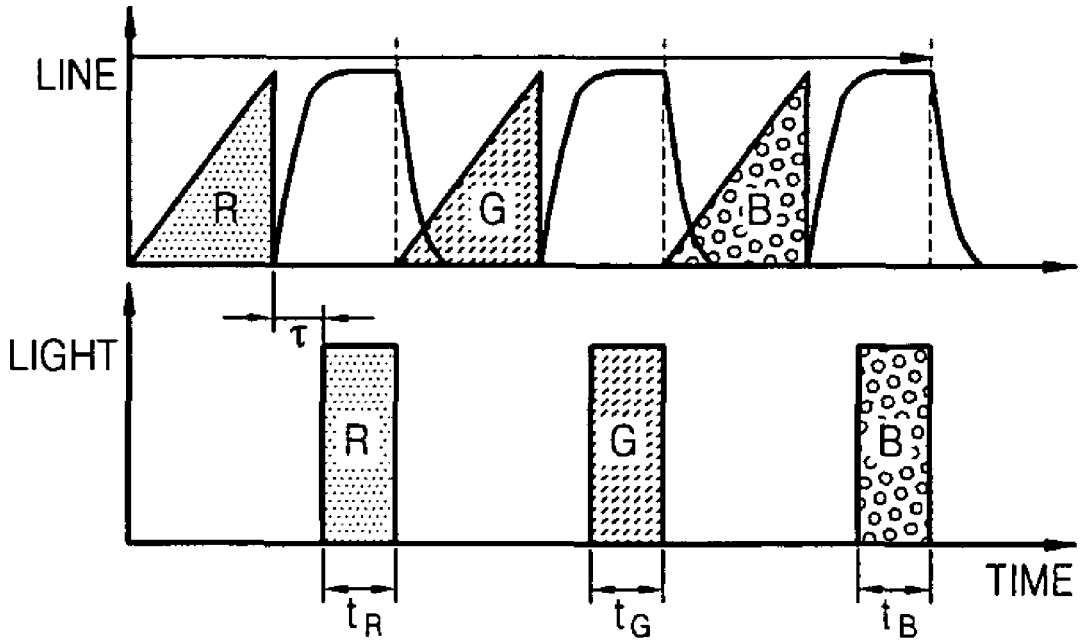
FIG. 1 (PRIOR ART)
FIG. 1 shows a basic method of driving a backlight of a field sequential display apparatus according to the related art.
Figure 2:
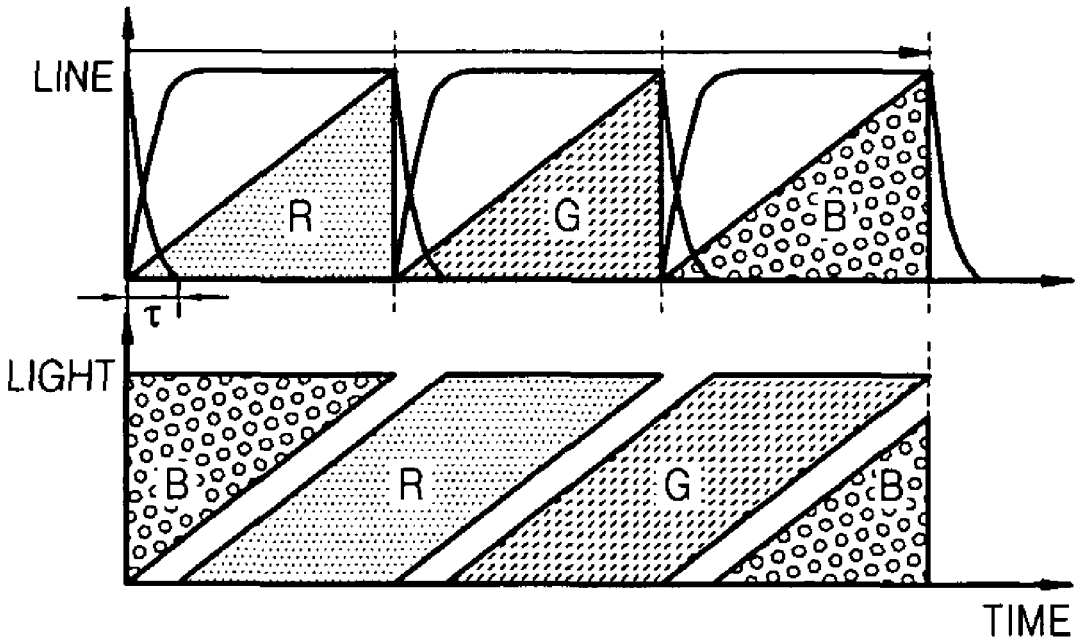
FIG. 2 (PRIOR ART)
FIG. 2 shows a drive method using a scrolling backlight of a field sequential display apparatus according to the related art.
Figure 3:
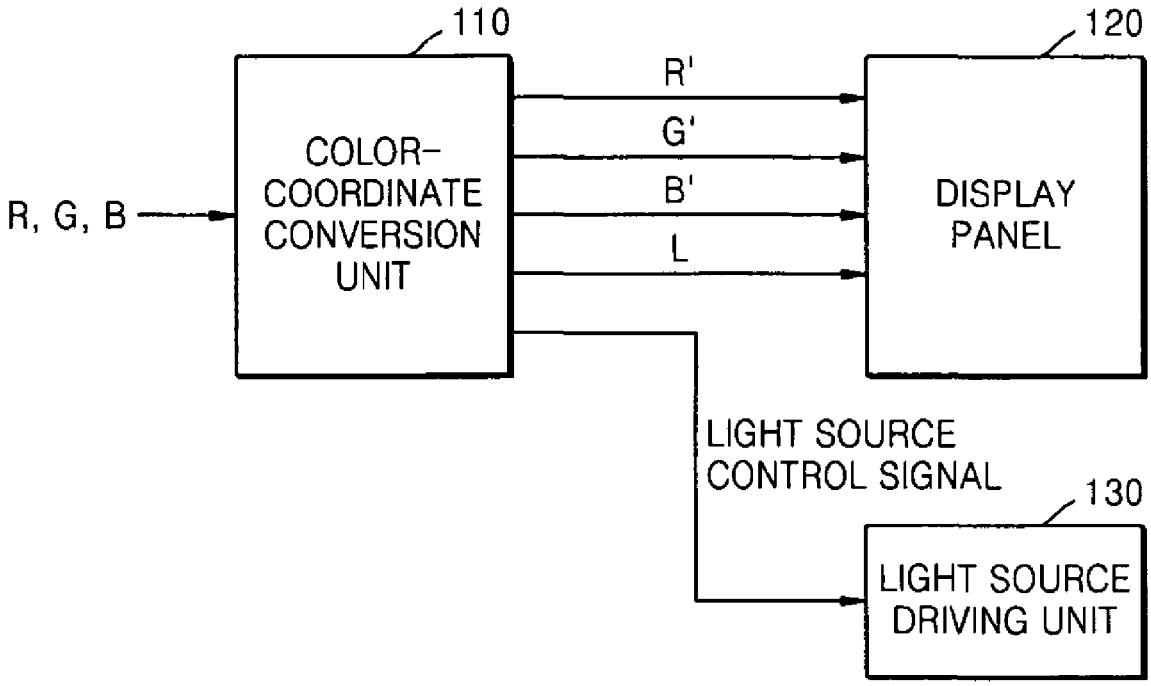
FIG. 3 shows a field sequential display apparatus according to an exemplary embodiment of the present invention.

FIG. 3 shows a field sequential display apparatus according to an exemplary embodiment of the present invention.

Referring to FIG. 3, a field sequential display apparatus 100 includes a color-coordinate conversion unit 110, a display panel 120, and a light source driving unit 130.

The color-coordinate conversion unit 110 converts a plurality of input image signals of primary colors representing one image into image signals of primary colors and image signals of one or more specific colors that can be created by the image signals of primary colors. Assuming that one image is composed of as many as m image signals of primary colors 11, 12, 13, . . . , 1*m*, through a color-coordination conversion in a color space, the color-coordinate conversion unit 110 converts the image signals of primary colors 11, 12, 13, . . . , 1*m* into image signals 11', 12', 13', . . . , 1*m*', L1, L2, . . . , Ln composed of image signals of primary colors and image signals of specific colors that can be created by the image signals of primary colors, where 11', 12', 13', . . . , 1*m*' are level converted image signals of primary colors, and the L1, L2, . . . , Ln are image signals of specific colors that can be created in the color space by the image signals of primary colors.

For example, the color-coordinate conversion unit 110 converts input image signals of primary colors R, G, and B, into image signals of four colors R', G', B', and L, where L is any color that can be created in an RGB color space. Specifically, to convert image signals through the color-coordinate conversion, a gain value g of a specific color and coefficients of colors R, G, and B have to determined to satisfy the following Equation 1.

$$\alpha R+\beta G+\gamma B=gL+\alpha' R+\beta' G+\gamma' B \quad (1)$$

Numerous solutions for g, α', β', and γ' satisfy Equation 1. Thus, the color-coordinate conversion unit 110 first determines the gain value g of a specific color L, and then determines coefficients α', β', and γ' representing the levels of the colors R, G, and B.

Figure 4:
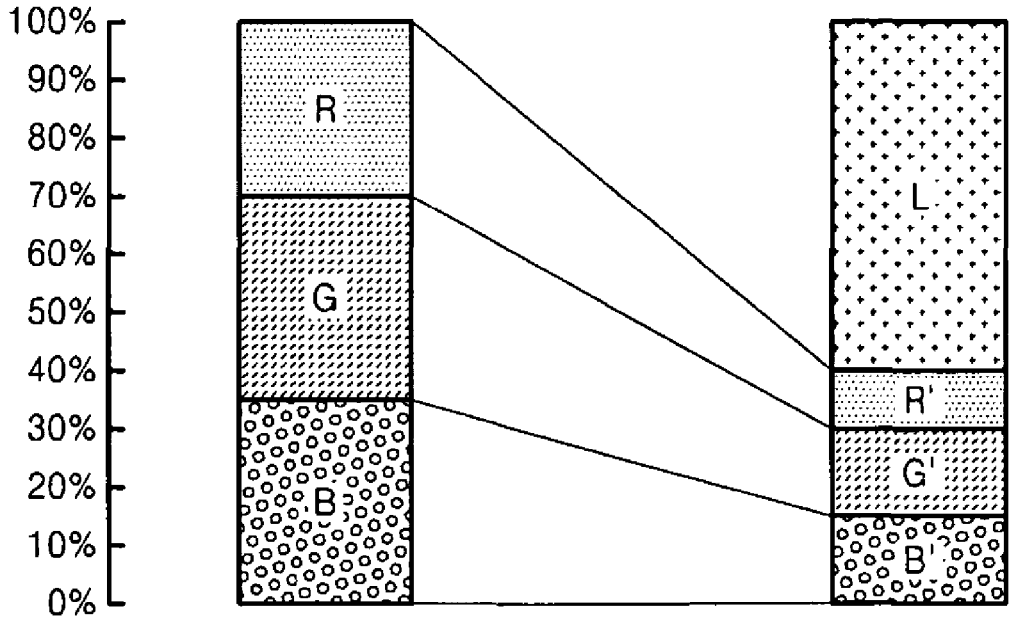
FIG. 4 shows an example of converting image signals of RGB primary colors in a color-coordinate conversion unit according to the present invention.

FIG. 4 shows an example of converting image signals of RGB primary colors in a color-coordinate conversion unit according to the present invention.

Referring to FIG. 4, through the color-coordination conversion, the color-coordinate conversion unit 110 converts input image signals of primary colors RGB into level-reduced image signals of primary colors R', G', and B' and an image signal of the specific color L that can be created by the colors R, G and B. The image signals which are output from the color-coordinate conversion unit 110 comprise the image signals of primary colors at reduced levels and the image signal of the specific color L at increased levels, thereby avoiding color breakup. The specific color L signal may be a luminance signal.

The display panel 120 displays the image signals which are converted by the color-coordinate conversion unit 110 on a screen.

The light source driving unit 130 sequentially drives light sources corresponding to the converted image signals. At this time, the color-coordinate conversion unit 110 outputs a light source control signal to the light source driving unit 130 according to the result of converting the input image signals. The light source driving unit 130 receives the light source control signal and sequentially drives light sources (not shown) corresponding to the converted colors to display the converted image signals on a screen.

Figure 5:
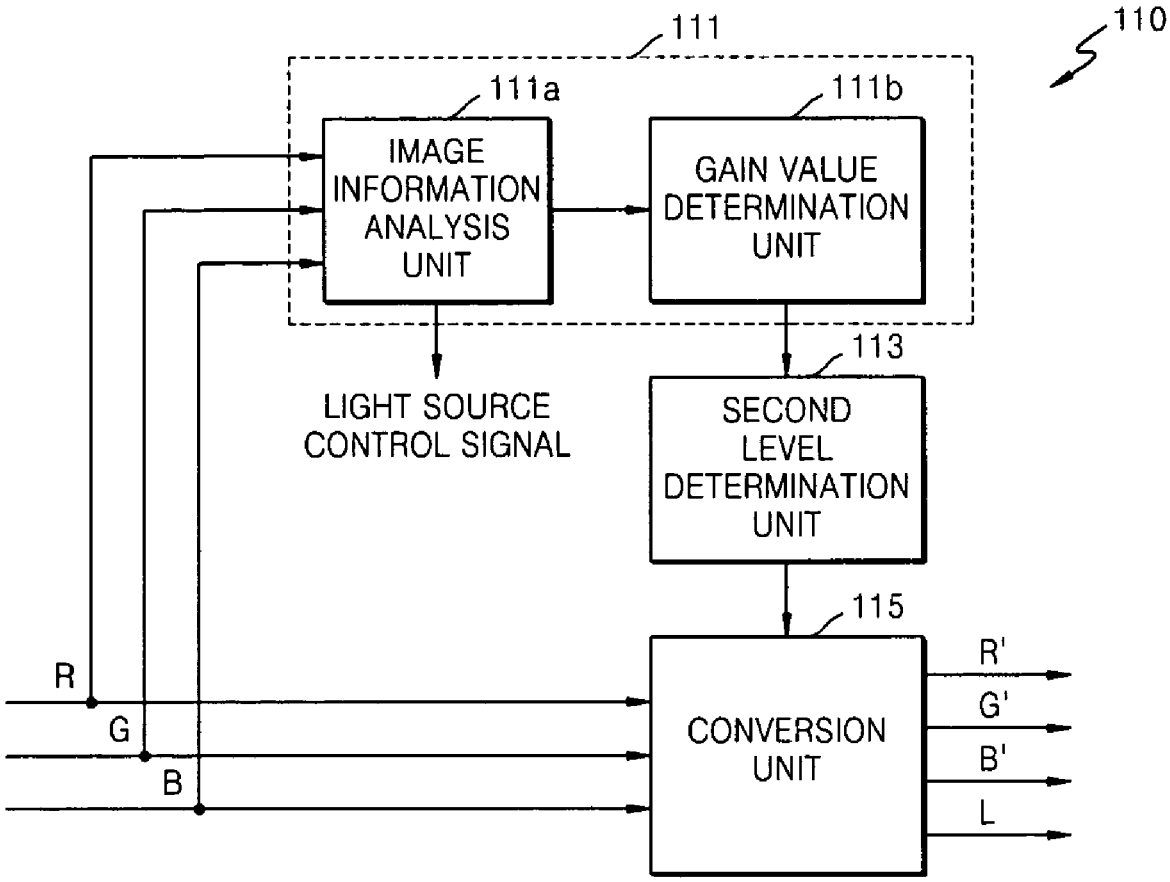
FIG. 5 is a block diagram of the configuration of a color-coordinate conversion unit according an exemplary embodiment of to the present invention.

FIG. 5 is a block diagram of the configuration of the color-coordinate conversion unit 110 according to an exemplary embodiment of the present invention.

Referring to FIG. 5, the color-coordinate conversion unit 110 includes a first level determination unit 111, a second level determination unit 113, and a conversion unit 115.

The first level determination unit 111 determines the level of an image signal of a specific color that can be created by input image signals of primary colors, and includes an image information analysis unit 111*a* and a gain value determination unit 111*b*.

The image information analysis unit 111*a* analyzes image state information of the input image signals of primary colors. The motion, luminance, histogram, correlation of each color, and dispersion of an image signal may be used for the image state information.

The gain value determination unit 111*b* determines the level of the image signal of the specific color by determining the gain value g of the image signal of the specific color that can be created by the input image signals of primary colors, using an image analysis result of the image information analysis unit 111*a*.

Figure 6A:
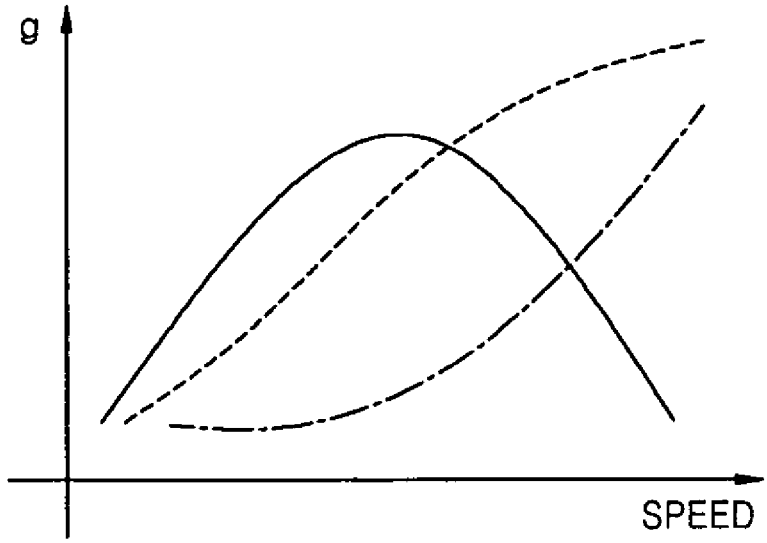
FIGS. 6A and B show an example of determining a gain value by a gain value determination unit based on image information, according to the present invention.
Figure 6B:
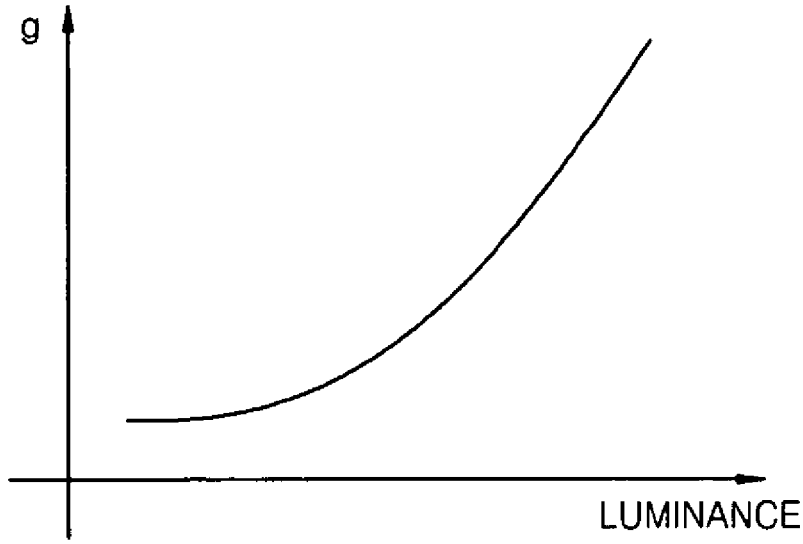

FIGS. 6A and B show an example of determining a gain value by a gain value determination unit based on image information, according to the present invention. FIG. 6A shows that the gain value g is determined in various ways based on the motion speed of an object constituting an image. FIG. 6B shows that the gain value g is determined in proportion to the luminance of an image.

Meanwhile, the image information analysis unit 111*a* outputs a light source control signal that controls the voltage applied to each light source or the irradiation time of the light source to the light source driving unit 130 by using information obtained through image analysis.

The second level determination unit 113 determines the levels of converted image signals of primary colors, based on the gain value g of the specific color determined by the gain value determination unit 111*b*. Namely, the levels of the image signals of primary colors are determined by determining coefficients α', β', and γ' representing the levels of colors R, G, and B.

The conversion unit 115 converts input image signals of primary colors into image signals of four colors R', G', B', and L, according to the levels of image signals of the specific color and primary colors determined by the first level determination unit 111 and the second level determination unit 113.

Figure 7:
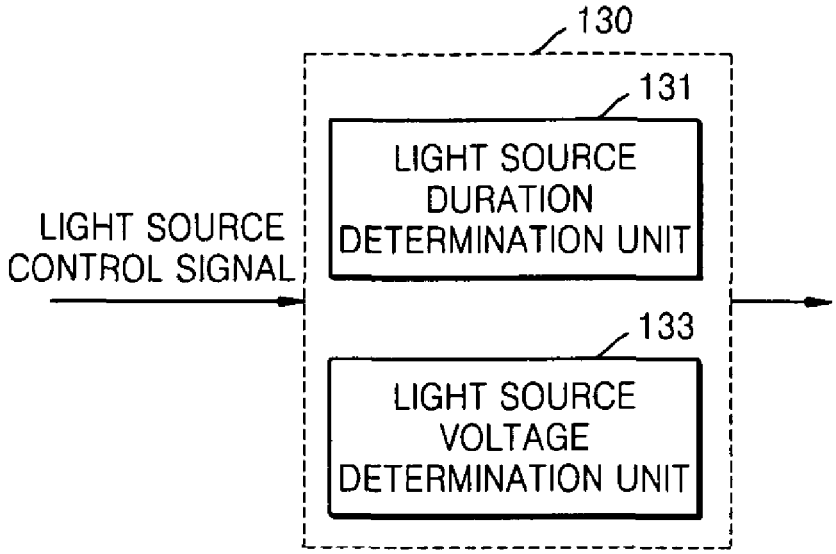
FIG. 7 is a block diagram of the configuration of a light source driving unit according to an exemplary embodiment of the present invention.

FIG. 7 is a block, diagram of the configuration of the light source driving unit 130 according to an exemplary embodiment of the present invention. Referring to FIG. 7, the light source driving unit 130 includes a light source duration determination unit 131 and a light source voltage determination unit 133.

The light source duration determination unit 131 controls turning on/off of a light source corresponding to each color converted by the color-coordinate conversion unit 110. The light source voltage determination unit 133 controls the brightness of each light source by controlling the voltage applied to each light source. The light source driving unit 130 can be controlled by a light source control signal which is output from the image information analysis unit 111*a* or by conditions set by a user.

Figure 8:
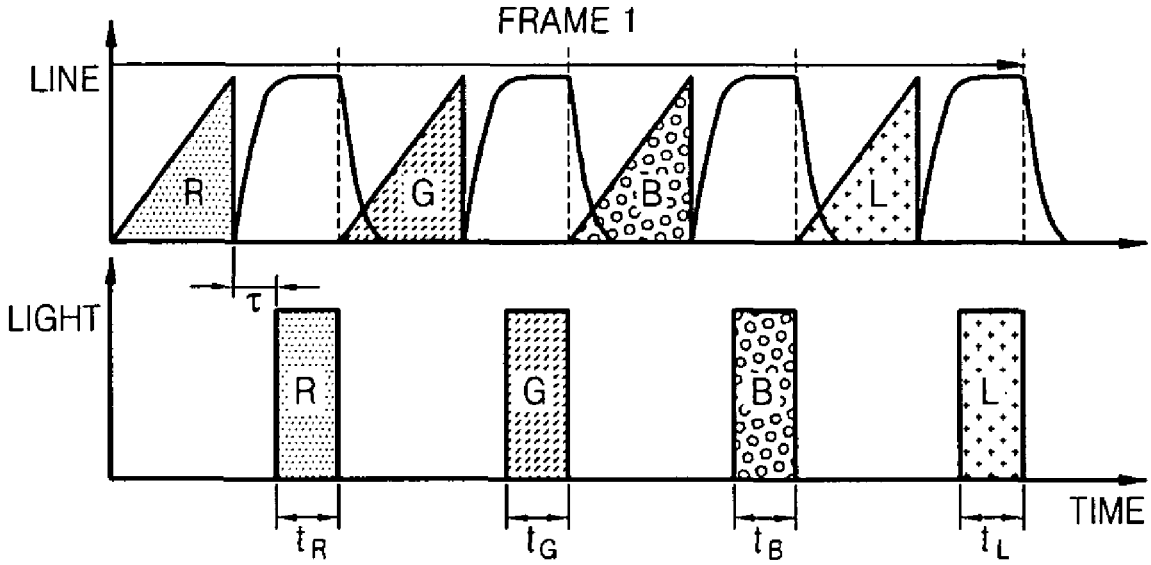
FIGS. 8 and 9 show a method of driving a field sequential display apparatus according to an exemplary embodiment of the present invention.
Figure 9:
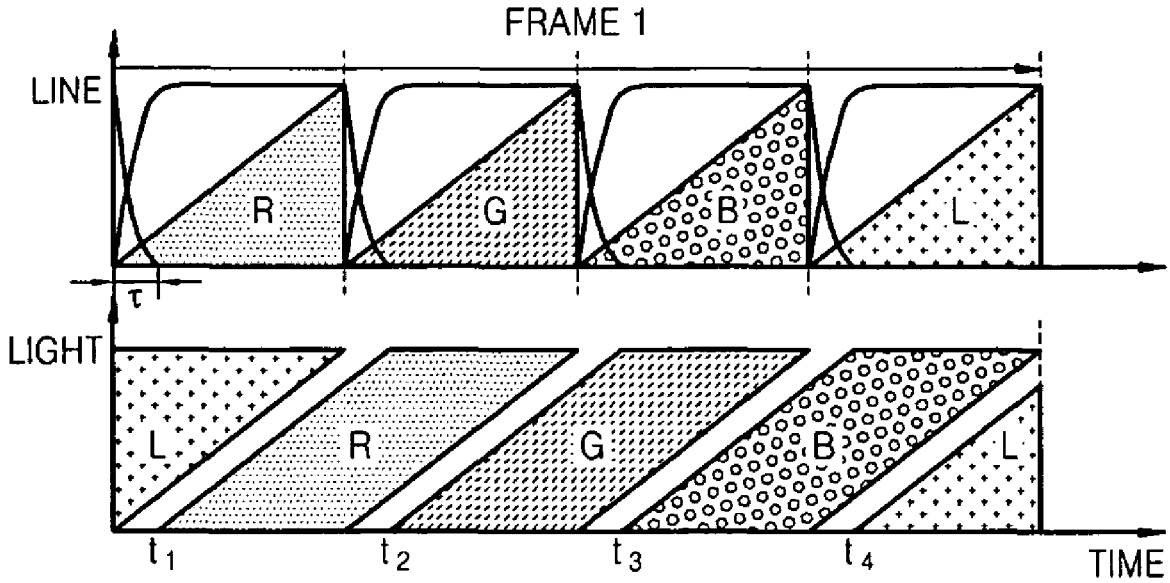

FIGS. 8 and 9 show a method of driving a field sequential display apparatus according to an exemplary embodiment of the present invention. FIG. 8 shows a method of driving a light source using a basic backlight driving method. FIG. 9 shows a method of driving a light source using a scrolling backlight driving method. In FIGS. 8 and 9, r denotes a minimum data write time for the display panel 120.

The method of driving a field sequential display apparatus according to the present invention is similar to the conventional field sequential driving method except that one frame is divided into a predetermined number of sub-frames based on the number of colors converted by the color-coordinate conversion unit 110, and is sequentially activated. For example, when the color-coordinate conversion unit 110 divides input image signals of primary colors RGB into image signals of four-color components R', G', B', and L, frame 1 is divided into four sub-frames. Namely, one frame is divided into four sub-frames, in which three sub-frames are allocated with a red sub-frame period $t_R$, a green sub-frame period $t_G$, and a blue sub-frame period $t_B$, and the last sub-frame is allocated with an L sub-frame period $t_L$ Referring to FIG. 8, in the frame 1, during the first sub-frame period, a red data signal R is first supplied to the display panel 120, and during the red sub-frame period $t_R$, a red light source of the backlight emits red light corresponding to the red data signal R to the display panel 120.

Next, during the second sub-frame period, that is, the green sub-frame period $t_G$, a green data signal G converted by the color-coordinate conversion unit 110 is supplied to the display panel 120, and during this period, a green light source of the backlight emits green light corresponding to the green data signal G to the display panel 120. Also, during the third sub-frame period, that is, the blue sub-frame period $t_B$, a blue data signal B converted by the color-coordinate conversion unit 110 is supplied to the display panel 120, and during this period, a blue light source of the backlight emits blue light corresponding to the blue data signal B to the display panel 120.

In addition, during the fourth sub-frame period, that is, the L color sub-frame period $t_L$, an L color data signal L converted by the color-coordinate conversion unit 110 is supplied to the display panel 120, and during this period, a light source emits light corresponding to the L color to the display panel 120.

As a result, in the frame 1, data signals of red R, green G, blue B, and the specific color L are supplied to the display panel 120, and light sources of R, G, B, and L corresponding thereto are sequentially turned on to form an image.

In addition, referring to FIG. 9, besides the basic backlight driving method of FIG. 8, a scrolling backlight driving method may be used, in which a screen is divided into areas, and light sources are respectively driven for the areas of the three primary colors and the specific color. Namely, light sources of R, G, B, and L are sequentially driven starting from an area where a liquid crystal responses completely.

Figure 10:
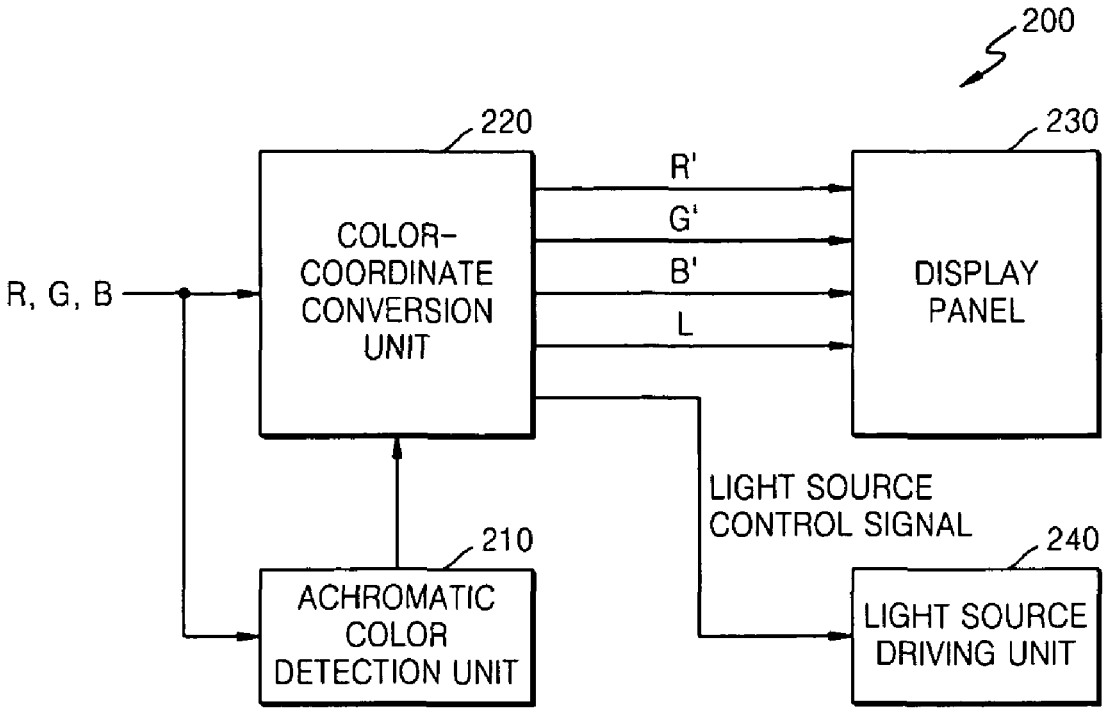
FIG. 10 is a block diagram of the configuration of a field sequential display apparatus according to another exemplary embodiment of the present invention.

FIG. 10 is a block diagram of the configuration of a field sequential display apparatus according to another exemplary embodiment of the present invention.

Referring to FIG. 10, a field sequential display apparatus 200 includes an achromatic color detection unit 210, a color-coordinate conversion unit 220, a display panel 230, and a light source driving unit 240.

The achromatic color detection unit 210 detects an image signal of an achromatic color such as black among input image signals, and informs the color-coordinate conversion unit 220 of the existence of the image signal of the achromatic color. The color-coordinate conversion unit 220 outputs a light source control signal for representing the image signal of the achromatic color. At this time, the RGB sub-fields are not required to represent the image signal of the achromatic color. Thus, the color-coordinate conversion unit 220 outputs the light source control signal such that one frame is displayed as a white W field instead of the RGB sub-fields.

The light source driving unit 240 receives the light source control signal, and turns on a light source so that one frame is the entire white W field, with the RGB sub-fields removed. The reason why only the image signal of the achromatic color is separately detected is that color breakup occurs easily when an achromatic color image moves.

The operation of the color-coordinate conversion unit 220, the display panel 230, and the light source driving unit 240, with respect to image signals other than the image signal of the achromatic color, are the same as in the exemplary embodiment of the present invention, so a detailed description of this will be omitted.

Figure 11:
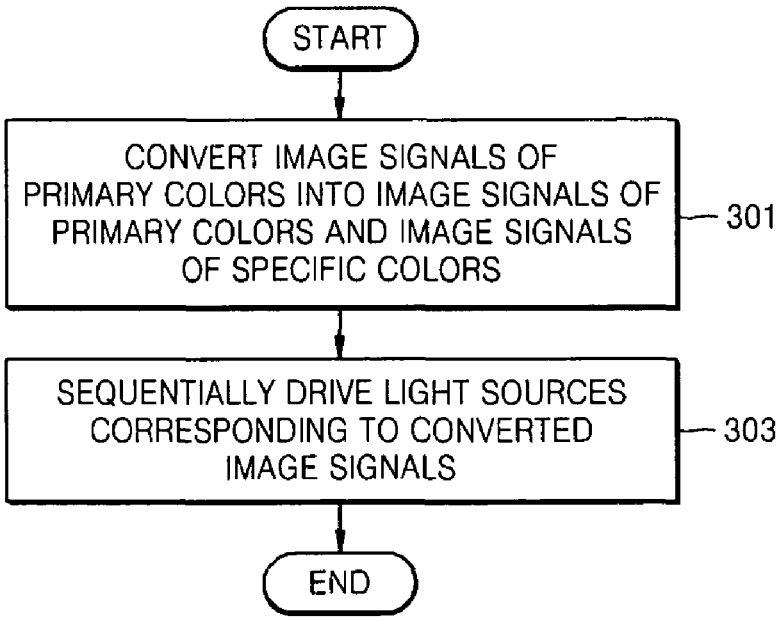
FIG. 11 is a flowchart of an image display method of a field sequential display apparatus according to an exemplary embodiment of the present invention.

FIG. 11 is a flowchart of an image display method of a field sequential display apparatus according to the present invention.

Referring to FIG. 11, input image signals of primary colors are converted into image signals of primary colors and image signals of specific colors (operation 301). As described above, when the image signals of the primary colors are composed of the three primary colors R, G, and B, the levels of the three primary colors are reduced through the color-coordinate conversion in the color space, while image signals of R', G', B', and L, including the specific color L that can be created by the three primary colors, are output.

Next, light sources corresponding to the converted image signals are sequentially driven to represent an image (operation 303).

Accordingly, a field sequential display apparatus and an image display method thereof of the present invention can prevent color breakup, thereby improving image quality.

While the present invention has been particularly shown and described with reference to exemplary embodiments thereof, it will be understood by those skilled in the art that various changes in form and detail may be made therein without departing from the spirit and scope of the invention as defined by the appended claims. The exemplary embodiments should be considered in a descriptive sense only, and not for purposes of limitation. Therefore, the scope of the invention is defined not by the detailed description of the invention but by the appended claims, and all differences within the scope will be construed as being included in the present invention.

What is claimed is:

1. An image display apparatus using a field sequential driving method, the image display apparatus comprising:

an achromatic color detection unit which detects whether one of a plurality of first image signals of primary colors is an achromatic color signal;

a color-coordinate conversion unit which converts the plurality of first image signals of primary colors representing one image into a plurality of second image signals of the primary colors and at least one specific color based at least on one of image state information of the first image signals of the primary colors and detecting the achromatic color signal; and a display panel which displays the second image signals in sub-fields of a frame, each corresponding to a respective second image signal, wherein the image state information comprises at least one of a luminance, a histogram, a correlation of each color, and a distribution of an image, and the color-coordinate conversion unit outputs a light source control signal such that an entirety of the frame is displayed as a white field with the sub-fields removed, when the one of the plurality of first image signals of primary colors is the achromatic color signal, wherein the primary colors are red, green, and blue, the first image signals of the red, green, and blue colors have levels represented by coefficients $\alpha$, $\beta$, and $\gamma$, respectively, and the color-coordinate conversion unit comprises:

a gain value determination unit which determines a gain value g of the second image signal of the at least one specific color based on the image state information of the first image signals of the primary colors;

a second level determination unit which determines $\alpha'$, $\beta'$, and $\gamma'$ levels of the second image signals of the primary colors based on the determined gain value g of the second image signal of the at least one specific color; and a conversion unit which converts the first image signals of the primary colors into the second image signals of the primary colors and the at least one specific color based on the determined levels $\alpha'$, $\beta'$, and $\gamma'$ of the second image signals of the primary colors and the gain value g of the at least one specific color, wherein the $\alpha'$, $\beta'$, and $\gamma'$ levels of the second image signals are determined to satisfy: $\alpha R+\beta G+\gamma B=gL+\alpha' R+\beta' G+\gamma' B$, where L is the second image signal of the at least one specific color.

2. The image display apparatus of claim 1, further comprising a light source driving unit which sequentially drives light sources corresponding to the primary colors and the at least one specific color of the second image signals.

3. The image display apparatus of claim 2, wherein the gain value determination unit is embodied in a first level determination unit which determines a level of the second image signal of the at least one specific color based on the gain value g.

4. The image display apparatus of claim 3, wherein the first level determination unit comprises:

an image information analysis unit which analyzes the image state information of the first image signals of the primary colors; and wherein the gain value determination unit determines the level of the second image signal of the at least one specific color based on the gain value g of the second image signal of the at least one specific color based on an image analysis result of the image information analysis unit.

5. The image display apparatus of claim 2, wherein the image signal of the at least one specific color is a luminance signal.

6. The image display apparatus of claim 1, wherein:

the conversion unit omits converting the first image signals of the primary colors into the second image signals of the primary colors and the at least one specific color based on detecting the achromatic color signal in the plurality of first image signals.

7. The image display apparatus of claim 1, further comprising:

a light source driving unit which sequentially drives light sources corresponding to the primary colors and the at least one specific color of the second image signals to be lit in each respective sub-field.

8. The image display apparatus of claim 7, wherein:

the conversion unit omits converting the first image signals of the primary colors into the second image signals of the primary colors and the at least one specific color based on detecting the achromatic color signal in the plurality of first image signals, and outputs the light source control signal to display the entirety of the frame as the white field, and the light source driving unit receives the light source control signal and turns on the light sources to be lit as white light so that the entirety of the frame is displayed as the white field with the sub-fields removed.

9. An image display method using a field sequential driving method, the image display method comprising:

detecting whether one of a plurality of first image signals of primary colors is an achromatic color signal;

converting the plurality of first image signals of primary colors into second image signals of the primary colors and at least one specific color based at least on one of image state information of the first image signals of the primary colors and detecting the achromatic color signal;

displaying the second image signals of the primary colors and the at least one specific color in sub-fields of a frame, each corresponding to a respective second image signal, by sequentially driving light sources corresponding to the primary colors and the at least one specific color of the second image signals; and outputting a light source control signal such that an entirety of the frame is displayed as a white field, with the sub-fields removed, when the one of the plurality of first image signals of primary colors is the achromatic color signal, wherein the image state information comprises at least one of a luminance, a histogram, a correlation of each color, and a distribution of an image, and wherein the primary colors are red, green, and blue, the first image signals of the red, green, and blue colors have levels represented by coefficients α, β, and γ, respectively, and the converting the plurality of first image signals of primary colors into second image signals of the primary colors and at least one specific color comprises:

determining a gain value g of the second image signal of the at least one specific color based on the image state information of the first image signals of the primary colors;

determining α', β', and γ' levels of the second image signals of the primary colors based on the determined gain value g of the second image signal of the at least one specific color; and converting the first image signals of the primary colors into the second image signals of the primary colors and the at least one specific color based on the determined levels α', β', and γ' of the second image signals of the primary colors and the gain value g of the at least one specific color, wherein the α', β', and γ' levels of the second image signals are determined to satisfy:

$$\alpha R+\beta G+\gamma B=gL+\alpha' R+\beta' G+\gamma' B,$$

where L is the second image signal of the at least one specific color.

10. The image display method of claim 9, wherein the converting of the first image signals of the primary colors into the second image signals of the primary colors and the at least one specific color comprises:

determining a level of the second image signal of the at least one specific color based on the gain value.

11. The image display method of claim 10, wherein the determining the level of the second image signal of the at least one specific color comprises:

analyzing the image state information of the first image signals of the primary colors; and determining the level of the second image signal of the at least one specific color based on the gain value g of the second image signal of the at least one specific color based on a result of the analyzing of the image state information.

12. The image display method of claim 9, wherein the second image signal of the at least one specific color is a luminance signal.

13. A non-transitory computer-readable medium having embodied thereon a computer program for executing an image display method using a field sequential driving method, the image display method comprising:

detecting whether one of a plurality of first image signals of primary colors is an achromatic color signal;

converting the plurality of first image signals of primary colors into second image signals of the primary colors and at least one specific color based at least on one of image state information of the first image signals of the primary colors and detecting the achromatic color signal;

displaying the second image signals of the primary colors and the at least one specific color in sub-fields of a frame, each corresponding to a respective second image signal, by sequentially driving light sources corresponding to the primary colors and the at least one specific color of the second image signals; and outputting a light source control signal such that an entirety of the frame is displayed as a white field, with the sub-fields removed, when the one of the plurality of first image signals of primary colors is the achromatic color signal, wherein the image state information comprises at least one of a luminance, a histogram, a correlation of each color, and a distribution of an image, wherein the primary colors are red, green, and blue, the first image signals of the red, green, and blue colors have levels represented by coefficients α, β, and γ, respectively, and the converting the plurality of first image signals of primary colors into second image signals of the primary colors and at least one specific color comprises:

determining a gain g of the second image signal of the at least one specific color based on the image state information of the first image signals of the primary colors;

determining α', β', and γ' levels of the second image signals of the primary colors based on the determined gain g of the second image signal of the at least one specific color; and converting the first image signals of the primary colors into the second image signals of the primary colors and the at least one specific color based on the determined levels α', β', and γ' of the second image signals of the primary colors and the gain g of the at least one specific color, wherein the α', β', and γ' levels of the second image signals are determined to satisfy:

$$\alpha R+\beta G+\gamma B=gL+\alpha' R+\beta' G+\gamma' B,$$

where L is the second image signal of the at least one specific color.

* * * * *